US006840658B2

(12) United States Patent
Anderson et al.

(10) Patent No.: US 6,840,658 B2
(45) Date of Patent: Jan. 11, 2005

(54) GRAPHIC STREET CAGE

(75) Inventors: Eric W. Anderson, Red Lion, PA (US); Donald Fentress, Fulton, MD (US)

(73) Assignee: Genlyte Thomas Group LLC, Louisville, KY (US)

( * ) Notice: Subject to any disclaimer, the term of this patent is extended or adjusted under 35 U.S.C. 154(b) by 63 days.

(21) Appl. No.: 10/117,535

(22) Filed: Apr. 5, 2002

(65) Prior Publication Data

US 2004/0246727 A1 Dec. 9, 2004

(51) Int. Cl.[7] ..... F21S 13/10

(52) U.S. Cl. ..... 362/367; 362/363; 362/431; 362/812

(58) Field of Search ..... 362/363, 367, 362/431, 812, 806; 40/564, 574, 659, 661.02; D26/67, 113, 118

(56) References Cited

U.S. PATENT DOCUMENTS 4,318,237 A * 3/1982 Hicks ..... 40/502
5,435,087 A * 7/1995 Karkar et al. ..... 40/575
5,572,819 A * 11/1996 Topinka et al. ..... 40/570
6,017,131 A * 1/2000 Goins ..... 362/249
6,450,657 B1 * 9/2002 Testa et al. ..... 362/31
D469,565 S * 1/2003 Anderson et al. ..... D26/119

OTHER PUBLICATIONS

Refractive Globes 1998 catalog, p. Nos. 4, 5, 8, 9, and 19, published by Hadco Lighting, Littlestown, Pennsylvania USA.

* cited by examiner

*Primary Examiner*—Thomas M. Sember
(74) *Attorney, Agent, or Firm*—John F. Salazar; Steven A. Witters; Middleton Reutlinger

(57) ABSTRACT

A street graphic cage for a post top light wherein the cage is installed around a globe positioned on said post. The street graphic cage has an upper frame element defining a plurality of panel apertures. The panel apertures receive translucent panels therein such that they may be backlit and illuminated. The panels are readily removable without entry into the globe or electrical system of the post top light and may contain user defined indicia thereon. The upper frame element may also have a plurality of logo block apertures which can receive either translucent logo blocks or decorative die-cast aluminum blocks. The cage may also have a lower circular frame element for affixing the cage to the post top light below the globe.

23 Claims, 5 Drawing Sheets

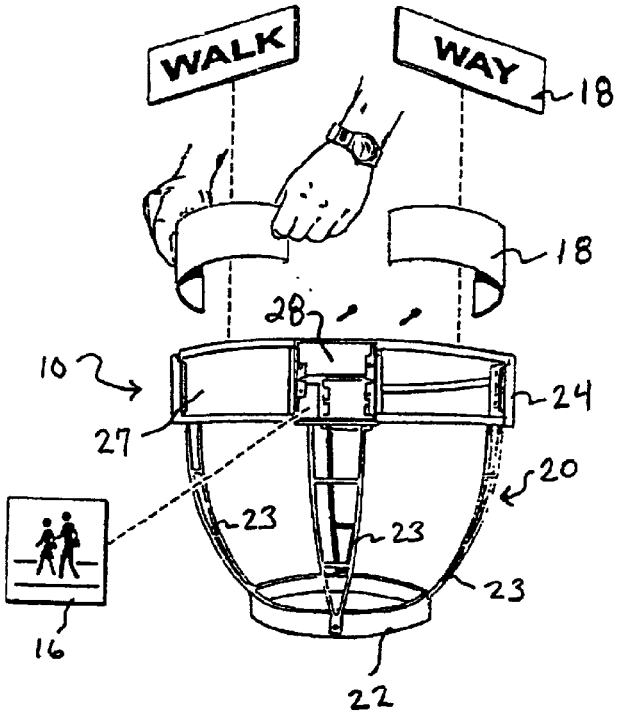
Fig. 3
Fig. 4
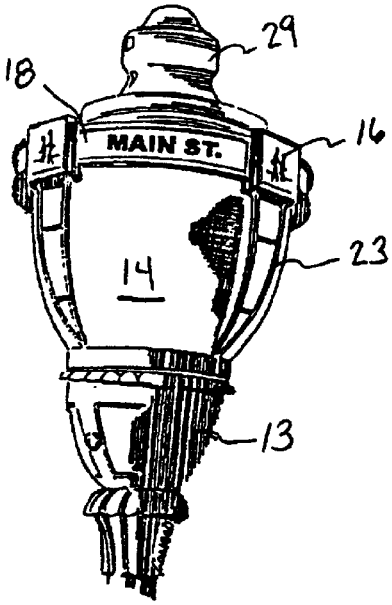

GRAPHIC STREET CAGE

FIELD OF THE INVENTION

The present invention is directed towards a street graphic cage for a post top street lamp, and more particularly, to a post top street graphic cage which allows for ready insertion of a translucent panel readily visible in either day or night.

SUMMARY OF THE INVENTION

One object of the present invention is to provide a street graphic cage which has a decorative element for post top light fixtures.

Another object of the present invention is providing a post top lighting fixture wherein a street graphic cage surrounds the luminaire and wherein the cage provides for end user customization of illuminatable panels.

A further object of the present invention is to provide for a street graphic cage which is modular in design and which may be installed to surround a street post top light fixture and which allows for alteration of decorative translucent panels without entry into the luminaire.

An even further object of the present invention is to provide a post top street graphic cage which surrounds a refractive post top street light globe wherein the street graphic cage has a plurality of decorative translucent panels each of which may be replaced or changed without entry or disconnection of the electrical connections to the post top luminaire.

An additional object of the present invention is to provide a street graphic cage which is modular in design and which has a plurality of translucent panels which may be readily inserted into the street graphic cage for illumination by the luminaire, the translucent panels being interchangeable and containing street identification indicia.

These and many other objects of the invention are accomplished with the street graphic cage and post top lighting luminaire of the present invention. The street graphic cage of the present invention includes a means for illuminating street identification indicia while also allowing the street identification indicia to be interchanged without disassembly of the street graphic cage and without tools. Thus, a tool-less entry street graphic cage luminaire is provided wherein the translucent panels or street identification indicia may be replaced in a ready fashion.

The street graphic cage of the present invention surrounds a prismatic refractive globe or other post top street light and allows for user interchangeable illuminatable indices. The street graphic cage may sit upon a light post support at the top of a light post and has a lower frame element connected to an upper frame element by a plurality of connection ribs. The upper frame element may provide a plurality of panel apertures and block apertures wherein the end user may define the translucent material to be inserted into the apertures.

Therefore, the present invention is directed towards a street graphic cage which may be modular with the refractive post top globe or other luminaire and which utilizes the illumination characteristics of the luminaire to illuminate the interchangeable translucent panels. The interchangeable translucent panels may be positioned into a number of panel apertures and retained in place by utilizing a pair of retention tabs located on an interior portion of the upper frame element thereby allowing the panels to be readily removed and inserted into the street graphic cage without need for tools and disassembly of the post top luminaire. The street graphic cage surrounds the refractive globe of the luminaire and is modular therewith.

The translucent sign panels used in the present invention may be made of high gloss vinyl which abuts against the refractive globe of the post top light and which are located within the panel aperture of the street cage. Additional logo apertures may be provided next to the panel aperture of the street cage in order to allow interchangeable logo blocks be installed within the cage.

These and other objects of the present invention are met with the street graphic cage of the present invention. However, many other objects of the invention may be interpreted from the teachings herewith and no unnecessary limitations are to be construed from the specific objectives outlined herein without also taking into consideration the entirety of the specification, claims and drawings which are a part hereof.

BRIEF DESCRIPTION OF THE DRAWINGS

A better understanding of the invention will be had upon reference to the following description in conjunction with the accompanying drawings in which like numerals refer to like parts throughout the several views and wherein:

FIG. 3 is a perspective disassembled view of the street graphic cage of the present invention without the underlying post top lighting fixture;

FIG. 4 is a perspective view of the street graphic cage of the present invention in use;

DETAILED DESCRIPTION OF THE PREFERRED EMBODIMENT

Figure 1:
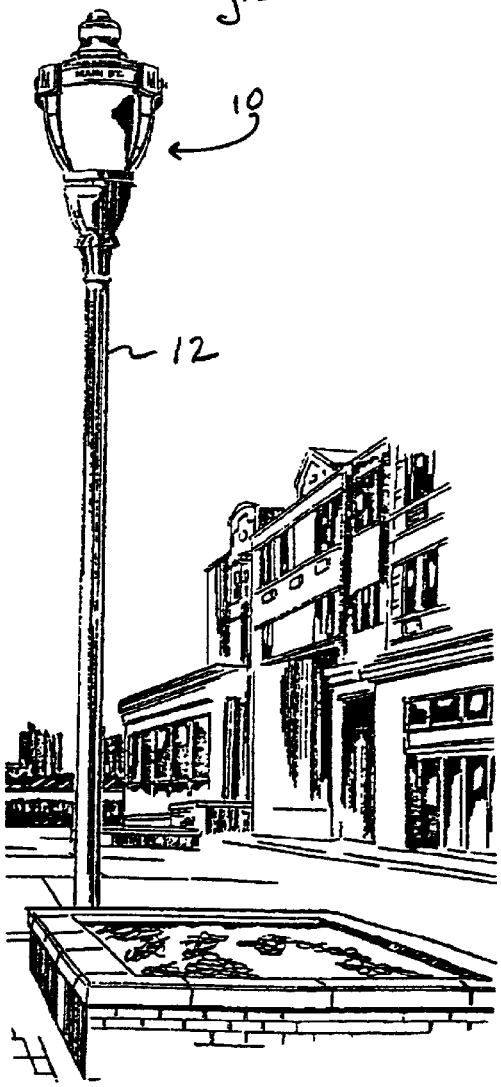
FIG. 1 is a front perspective view of the street graphic cage of the present invention in use.
Figure 2:
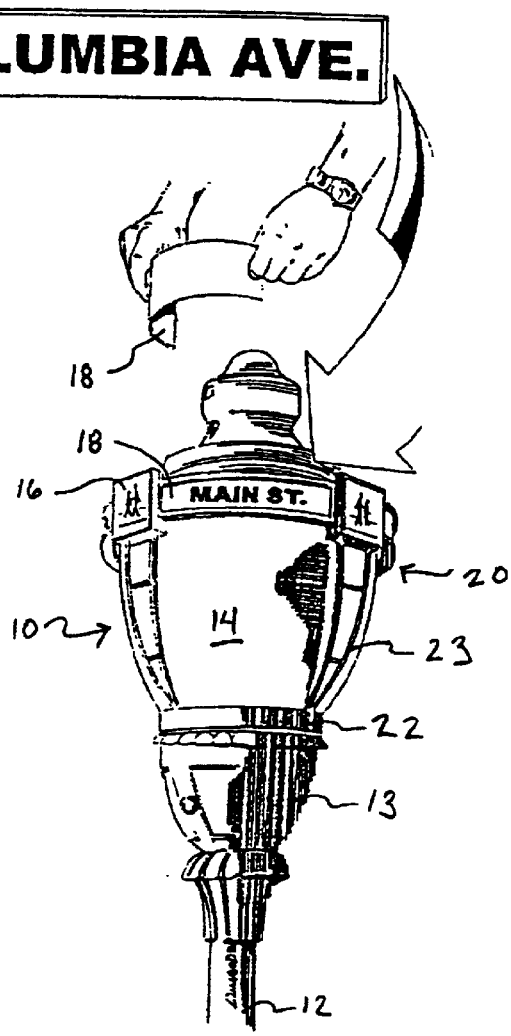
FIG. 2 is a close up frontal view of the street graphic cage of the present invention disclosing insertion of the translucent panels.

The fully assembled street graphic cage of the present invention is depicted in FIG. 1 wherein the post top light fixture 10 sits atop a light post 12 in standard fashion for illumination of a predefined area therebelow. The post top light fixture 10, as seen in conjunction with FIG. 2, is comprised of a prismatic refractive globe or other lamp enclosing device14 which itself is surrounded by the street graphic cage 20. The street graphic cage 20, depicted in FIGS. 1 and 2, may attach directly to the light post support and also be affixed to the globe 14 at the lower portion thereof. The street graphic cage 20 provides a mechanism for supporting a plurality of sign panels 18 and logo blocks 16 in illuminating relationship with the globe 14 and light source or lamp located therein.

Used in conjunction with the post top light fixture 10 and street graphic cage 20 of the present invention are a plurality of sign panels 18 which may be acrylic having high gloss vinyl. As shown in FIG. 2, the translucent sign panel 18 may be slightly deformed or bent for insertion into one of the panel apertures 27 formed in the upper frame element 24. The sign panel 18 is received within the panel aperture and as depicted the upper frame element 24 may have a plurality of apertures located therein for receiving the opal acrylic sign panels 18. As shown in the embodiment of the figures, four panel apertures 27 are provided for displaying the panels in 90 degree segments around the upper frame element. However, a number of varying implementations for use of panel apertures in conjunction with translucent panels fall within the teaching of the invention described herein and no unnecessary limitations are to be interpreted from the exemplary construction depicted.

Turning now to FIGS. 3 and 4 depicting the street graphic cage 20 of the present invention and its implementation on a post top environment, it is clear that the street graphic cage 20 of the present invention allows previous post top luminaires to be converted into graphic panel displays. As the lamp or other light source within the globe 14 emits light from the globe 14, the street graphic cage 20 of the present invention positions the translucent sign panels 18 in a position wherein the plurality of acrylic signs 20 may be readily illuminated and visible, either day or night. The cage 20, as shown in FIG. 3, may be constructed of aluminum or other rigid supporting material. The street graphic cage 20 has a lower frame element 22, an upper frame element 24 and ribs 23 connecting the two. In this example, the lower and upper frame elements 22 and 24 are depicted as being annular. However, any geometric construct allowing the panels apertures to position the panels within illumination distance from the light source within the globe 14 is sufficient. Further, lower and upper frame elements can be formed alternatively in square, rectangular or other geometries matching the lamp support or other desired feature.

Figure 6:
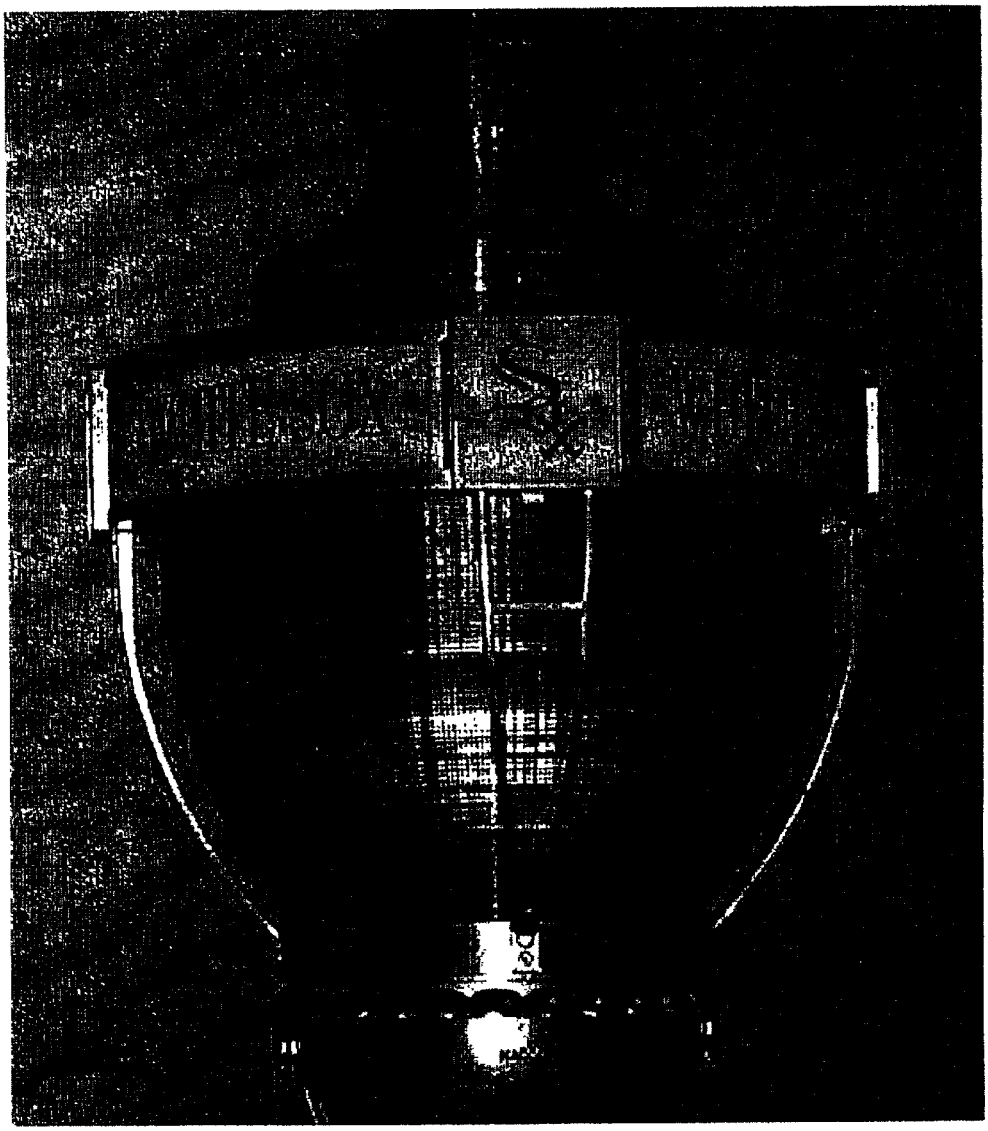
FIG. 6 is a close-up perspective view of the street graphic cage of the present invention fully installed on a post top light pole and assembled around a luminaire globe; and, FIG. 7 is a close up side sectional view of an alternative tool-less logo block design for the street graphic cage of the present invention.

The street graphic cage 20 depicted has a plurality of ribs which connect the lower frame element 22 with the upper frame element 24. The lower frame element 22 may be firmly retained within the lamp post support 13 around the exterior of the globe 14. The lower frame element 22 can be overlaid onto the lamp post support and affixed thereto by a plurality of screws or other retention elements, as shown in FIG. 6, or may be interiorly positioned between the globe and the lamp post support. The ribs 23 connect the upper frame element 24 to the rigid connection to the lamp post support 13 and support the upper frame element 24. As can be seen from the figures however, alternatively the upper frame element 24 may also be positioned on the lamp top 29 such that the panels 18 are readily illuminated within the need for support.

In the construction shown, the upper frame element 24 has a plurality of panel apertures 27 and also a plurality of block apertures 28. The panel apertures receive sign panels 18 while the block apertures receive the logo blocks 16. Logo blocks 16 may be translucent logo blocks or may alternatively be metal decorative blocks affixed to the upper frame element 24 in the block aperture 28. The upper frame element 24 may be viewed as having an upper cylindrical frame member 51 and a lower cylindrical frame member 52 which form the upper and lower edges or walls of the panel apertures 27. As shown in this example, the panel apertures therefore are constructed in rectangular geometry with the upper cylindrical frame member 51 forming the upper side or edge of the panel aperture while the lower cylindrical frame member 52 forms the lower side or edge of the panel aperture. The logo blocks 28 formed in the upper frame element 24 may separate the panel apertures and form the side walls or edge thereof As depicted, the logo blocks may be squared.

Figure 5:
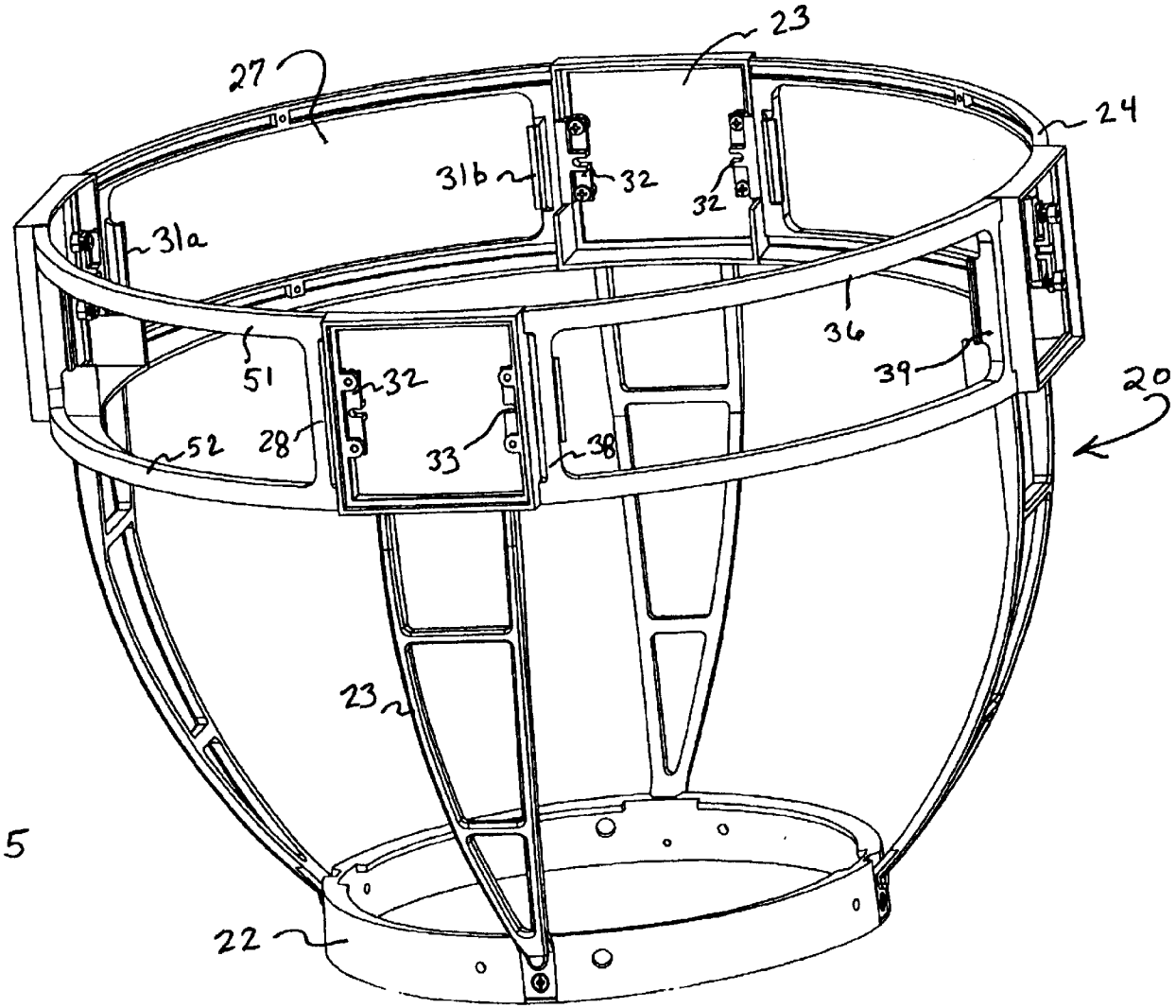
FIG. 5 is a close-up perspective view of the street graphic cage of the present invention.

As shown in FIG. 5, a close up of the street graphic cage 20 of the present invention is depicted wherein the panel apertures 27 are apparent as well as the retaining tabs 31*a* and 31*b* which hold the panel 18 in position. As can be seen from the figure, the positioning of the panel apertures 27 allows the plurality of panels 18 be removed and changed within the necessity of entry in to the globe 14 or other aspects of the post top light. Thus, a tool-less ability to modify the panels is provided. The panels 18 are retained in proper position within the panel apertures by opposing tabs 31*a*, 31*b* and allow the panels to be either slid down into proper positioning or they may be slightly bent, placed into position and then released wherein the outward flexing of the panels then forces the side edges into the retention tabs 31*a*, 31*b* within the upper frame element 24.

Also shown in FIG. 5 is the block aperture 28 which receives the logo blocks 16. The logo blocks 16 may be either translucent logo blocks having user definable indicia on them as with the translucent acrylic sign panels 18 or may be solid cast aluminum decorative blocks affixed within the logo block apertures 28. As shown in FIGS. 3 and 5, the translucent logo blocks 16 may be retained within the apertures 28 by use of brackets 32 and similarly be illuminated by the lamp or other light source located within the globe 14. Alternatively, decorative blocks which are rigid in construction may be affixed to the brackets 32 by use of screws which may enter through apertures 33 in brackets 32 to firmly hold the logo block in place.

Figure 7:
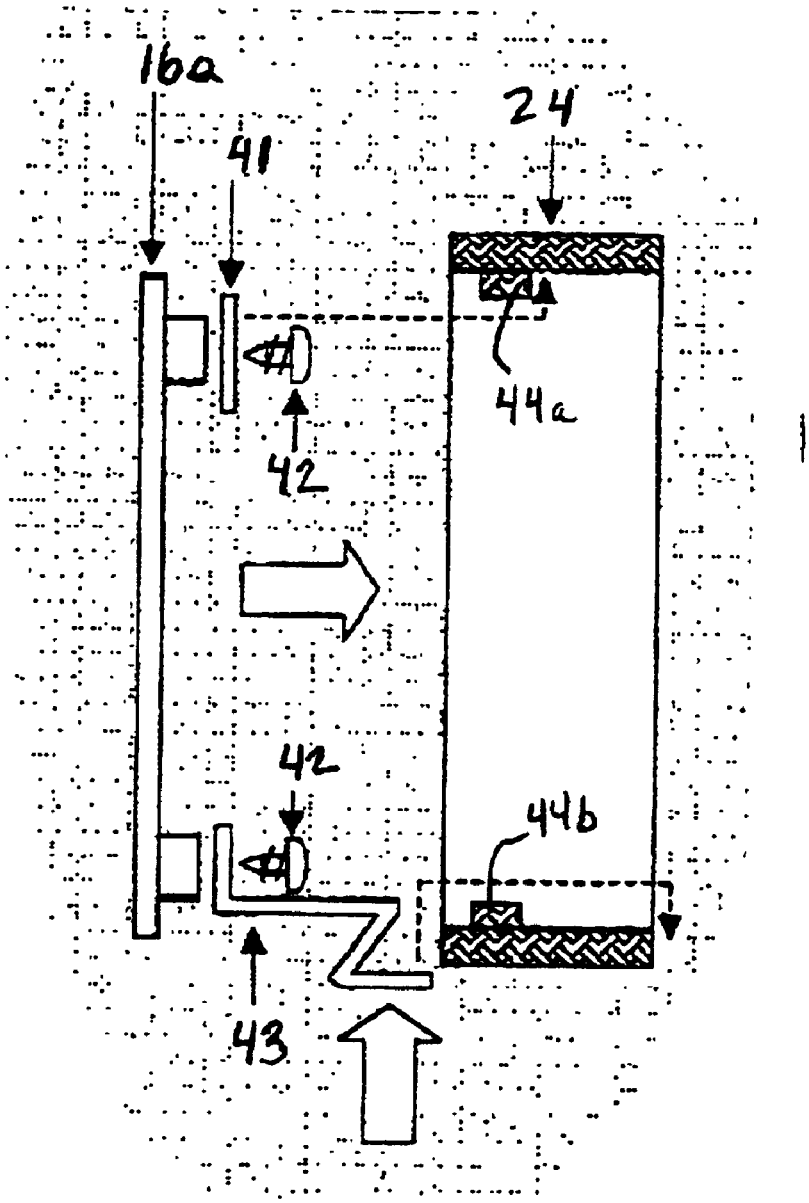

Turning to FIG. 7, an alternative embodiment of the logo block aperture 23 is shown in upper frame 24. The upper frame 24 at the point of the logo block aperture 23 is defined with a first and a second retaining elements 44*a* and 44*b* which allow tool-less changing of the logo block 16*a*. As shown, the block 16 may have a washer 41 attached to the upper portion by a threaded screw 42. Affixed to the lower portion of the logo block 16*a* is spring or clip 43 which is also attached by screw 42. When a change of the logo block 16*a* is desired, the new block may be easily inserted into aperture 23 by placing washer 41 and clip 43 behind the retaining elements 44*a* and 44*b*. This allows the logo blocks 16*a* to be easily replaced for seasonal displays or other particularized special occasion. These tool-less installable logo blocks 16*a* therefore provide an alternative to the other blocks shown or with solid or welded cast aluminum logo blocks. The modular design of the street graphic cage 20 therefore accepts the aluminum blocks, tool-less clip on mounted and screw attached logo blocks as shown herein.

The street graphic cage 20 of the present invention used in conjunction with the post top refractive globe 14 allows for the efficient backlighting of the translucent panels 18 located with the plurality of panel apertures 27. The street graphic cage 20 may be modular with the post top light source and allows for ready interchangeability of the panels 18 without entry into the post top light fixture. Thus, the plurality of panels 18 or logo panels 16 may be readily changed without disassembly of the street cage or entry into the post top light fixture.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A street graphic cage and post top light, comprising:

a light post, light post support and globe;

a street graphic cage surrounding said globe and having a lower frame element, an upper frame element and at least one rib interposed there between, said lower frame element affixed to said light post support, said upper frame element having at least one panel aperture, said at least one panel aperture retaining a translucent panel.

2. The street graphic cage and post top light of claim 1 wherein said street graphic cage has a plurality of panel apertures formed within said upper frame element, said plurality of panel apertures formed in spaced relationship around said globe, each of said panel apertures having a first and a second retention tab retaining a translucent panel therein.

3. The street graphic cage and post top light of claim 2 further comprising a plurality of logo block apertures, each of said logo block apertures retaining a logo block therein.

4. The street graphic cage and post top light of claim 3 wherein said logo block is a translucent acrylic logo block.

5. The street graphic cage and post top light of claim 3 wherein said logo block is a die cast aluminum logo block.

6. The street graphic cage and post top light of claim 1 wherein said upper frame element and said lower frame element are annular and wherein said at least one rib is four ribs interconnecting said upper frame element and said lower frame element.

7. The street graphic cage and post top light of claim 1 wherein said upper frame element has a first, second, third and fourth panel aperture formed therein in spaced surrounding relationship with said globe.

8. The street graphic cage and post top light of claim 7 wherein said upper frame element has a first, second, third and fourth logo block aperture formed therein, each of said logo block aperture interposed between a panel aperture.

9. The street graphic cage and post top light of claim 7 wherein said upper frame element has an upper cylindrical frame member and a lower cylindrical frame member, said upper cylindrical frame element forming a top side of said panel apertures and said lower cylindrical frame member forming a bottom side of said panel apertures.

10. The street graphic cage and post top light of claim 7 wherein said panel apertures in said upper frame element are rectangular.

11. The street graphic cage and post top light of claim 10 wherein said logo block apertures in said upper frame element are square.

12. A street graphic cage for surrounding a refractive globe on a post top light, comprising:

an upper frame element surrounding said globe of said post top light, said upper frame element having a plurality of panel apertures formed therein, each of said panel apertures having a retention mechanism formed therein and designed to receive a translucent sign panel, said upper frame element further having a plurality of logo block apertures, each of said logo block apertures having a retention bracket formed therein and designed to retain a logo block.

13. The street graphic cage of claim 12 further comprising a lower frame element affixed to said upper frame element by a plurality of ribs.

14. The street graphic cage of claim 12 wherein said logo block retained in each of said logo block apertures is a translucent logo block.

15. The street graphic cage of claim 12 wherein said logo block retained in each of said logo block apertures is a die cast aluminum decorative block affixed to said retention bracket using at least one screw.

16. The street graphic cage of claim 12 wherein said upper frame element is cylindrical and said plurality of panel apertures are spaced circumferentially around said upper frame element.

17. The street graphic cage of claim 16 wherein said plurality of panel apertures are four panel apertures.

18. The street graphic cage of claim 17 wherein said four panel apertures are separated from each other by one of said plurality of logo block apertures.

19. The street graphic cage of claim 18 wherein said upper frame element is affixed to a cylindrical lower frame element by a plurality of ribs interposed therebetween.

20. A street graphic cage, comprising:

an upper frame element having an upper cylindrical frame member and a lower cylindrical frame member;

a lower cylindrical frame element;

a plurality of ribs connecting said lower cylindrical frame element and said upper frame element;

wherein said upper cylindrical frame member forms an upper side to a plurality of panel apertures and wherein said lower cylindrical frame element forms a lower side to said plurality of panel apertures;

each of said panel apertures formed in said upper frame element having opposing retention elements and having a translucent panel removably retained therein, said panel having indicia located thereon, said indicia visible through said panel aperture.

21. The street graphic cage of claim 20 wherein lower cylindrical frame element is affixed to a light post support, said light post support affixed to a refractive globe, said street graphic cage surrounding said refractive globe.

22. The street graphic cage of claim 21 further comprising a plurality of logo block apertures formed in said upper frame element, each of said logo block apertures having a translucent logo block removably retained therein.

23. A street graphic cage for displaying interchangeable translucent panels around a refractive globe, comprising:

a street graphic cage surrounding a post top luminaire globe, said cage having a circular frame element for removably receiving a plurality of translucent panels, said frame element positioning said plurality of panels in spaced relationship around said globe on an exterior portion thereof, said cage having a plurality of panel receiving apertures, each of said apertures having a retention mechanism for releasably retaining one of said plurality of translucent panels therein, said retention mechanism in each of said apertures positioning said panel within said aperture adjacent said luminaire globe illuminating said panel.

* * * * *